US010947738B2

(12) United States Patent
Loh et al.

(10) Patent No.: US 10,947,738 B2
(45) Date of Patent: Mar. 16, 2021

(54) ADJUSTABLE BALUSTRADE SYSTEM

(71) Applicant: MOULURE ALEXANDRIA MOULDING INC., Alexandria (CA)

(72) Inventors: Lay Tee Loh, Chachoengsao (TH); Jerry Chabot, Alexandria (CA); Marc Hurtubise, Alexandria (CA); Fuzhong Liu, Alexandria (CA); Luc Titley, Alexandria (CA); Sean Cadney, Rivière-Beaudette (CA)

(73) Assignee: MOULURE ALEXANDRIA MOULDING INC., Alexandria (CA)

( * ) Notice: Subject to any disclaimer, the term of this patent is extended or adjusted under 35 U.S.C. 154(b) by 729 days.

(21) Appl. No.: 15/831,366

(22) Filed: Dec. 4, 2017

(65) Prior Publication Data

US 2018/0223538 A1 Aug. 9, 2018

(30) Foreign Application Priority Data

Feb. 7, 2017 (CA) ..... 2957252

(51) Int. Cl.
*E04F 11/18* (2006.01)

(52) U.S. Cl.
CPC ..... *E04F 11/1834* (2013.01); *E04F 11/1842* (2013.01); *E04F 2011/1821* (2013.01)

(58) Field of Classification Search
CPC ..... E04F 11/18; E04F 11/181; E04F 11/1812; E04F 11/1814; E04F 11/1834
See application file for complete search history.

(56) References Cited

U.S. PATENT DOCUMENTS

| | | | | |
|---|---|---|---|---|
| 4,928,930 | A * | 5/1990 | Chung | E04F 11/1834 256/65.03 |
| 6,736,373 | B2 * | 5/2004 | Greaves | E04F 11/1834 256/65.16 |
| 8,936,233 | B1 * | 1/2015 | Sneith | E04F 11/1812 256/67 |
| 2008/0173857 | A1 * | 7/2008 | Edwards | E04H 17/1421 256/67 |
| 2008/0277640 | A1 * | 11/2008 | Striebel | E04F 11/1812 256/67 |
| 2015/0252570 | A1 * | 9/2015 | Springborn | E04F 11/1834 256/67 |

* cited by examiner

*Primary Examiner* — Daniel J Wiley
(74) *Attorney, Agent, or Firm* — Loza & Loza, LLP; Heidi L. Eisenhut

(57) ABSTRACT

In at least one embodiment, it is contemplated that the present invention provides a baluster system including a handrail, at least one newel post having a shaft, a mounting plate abutting the shaft and adapted for fixing the newel post to a lower supporting surface, a plate abutting the shaft, and an intermediary shaft portion having a second end abutting the plate and a first end having a swivel mount adapted for fixing to the underside of the handrail, and at least one baluster having a first end having a swivel mount adapted for fixing to the underside of the handrail, a second end having a swivel mount for fixing to a lower supporting surface and a baluster shaft extending between the first end and the second end.

28 Claims, 4 Drawing Sheets

ADJUSTABLE BALUSTRADE SYSTEM

FIELD

The present invention relates to the field of commercial and residential construction. More specifically, the present application relates to improved balustrade, handrail, guardrail and stairway assemblies for use in a wide variety of both residential and commercial construction applications.

BACKGROUND

Handrail and guardrail assemblies, commonly known within the construction trade as balustrades, are typically installed adjacent staircases or raised platforms in order to provide a support when ascending or descending the stairway and to protect individuals or items from inadvertently falling from an elevated height while using the stairway.

Many prior art balustrades include at least one load bearing newel post, a number of intermediary balustrades and a handrail connecting an upper end of each of these components together. Accordingly, any suitable balustrade system has to be robustly built to withstand both vertical and horizontal loads applied directly to the handrail and horizontal shear forces which can be applied directly to handrail, newel posts or balustrades.

Therefore and as is readily appreciated by the skilled person, balustrades are subject to strict building codes that are highly dependent on the nature of the particular application under consideration.

Beyond the obvious and practical safety role that balustrades provide, these architectural components also lend a significant visual component to the aesthetic design of a room or space. As such, the replacement of a balustrade is a common task in many renovations and the selection of an appropriate balustrade "style" is an important step in the design and construction of a new house or building.

Accordingly, installation of a balustrade is a common task and must be completed with at least two goals in mind: first, the balustrade must be mounted in a secure manner to perform its essential safety function. Secondly, the balustrade must be installed in a manner that is visually appealing given the prominence of this architectural componentry.

As such, any developments which eliminate the possibility of insecure or shoddy installation would be greatly appreciated by the skilled person tasked with installing these components.

Accordingly, there is a need for a modular balustrade system that is visually appealing, adaptable and adjustable for a wide range of applications, easy to install and robust.

BRIEF SUMMARY

It is contemplated that the present invention can provide a modular balustrade system that is visually appealing, adaptable and adjustable for a wide range of applications, easy to install and robust.

More specifically, in at least one embodiment it is contemplated that the present invention can provide a balustrade system including a handrail extending between a first end and a second end and a having lower surface, at least one newel post having a shaft extending between a first end and a second end, a mounting plate abutting the first end of the shaft and adapted for fixing the newel post to a lower supporting surface, a plate abutting the second end of the shaft, and an intermediary shaft portion having a second end abutting the plate and a first end having a swivel mount adapted for fixing to the underside of the handrail, and at least one baluster vertically extending between a first end and a second end, the baluster having a first end having a swivel mount adapted for fixing to the underside of the handrail, a second end having a swivel mount for fixing to a lower supporting surface, and a baluster shaft extending between the first end and the second end.

In another embodiment it is contemplated that the present invention can provide a baluster for a baluster system, the baluster including a first end having a swivel mount adapted for fixing to the underside of a handrail, a second end having a swivel mount for fixing to a lower supporting surface, and a baluster shaft extending between the first end and the second end.

In yet another embodiment it is contemplated that the present invention can provide a newel post for a baluster system, the newel post including a shaft extending between a first end and a second end, a mounting plate abutting the first end of the shaft and adapted for fixing the newel post to a lower supporting surface, a plate abutting the second end of the shaft, and an intermediary shaft portion having a second end abutting the plate and a first end having a swivel mount adapted for fixing to the underside of a handrail.

DESCRIPTION OF THE DRAWINGS

The present invention will be better understood in connection with the following drawings, in which.

DETAILED DESCRIPTION OF THE EMBODIMENTS

Figure 1A:
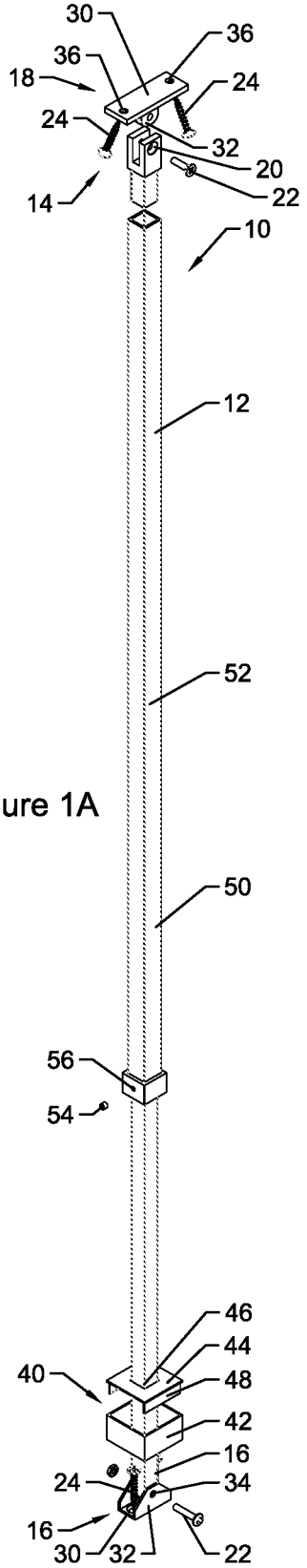
FIGS. 1A through 1C are isometric views of a baluster for use in connection with balustrade system in accordance with at least one embodiment of the present invention.

It is contemplated that the present invention provides a modular balustrade system that is visually appealing, adaptable and adjustable for a wide range of applications, easy to install and robust.

In at least one embodiment, it is contemplated that a balustrade system in accordance with the present invention can include at least one newel post, at least one baluster and a handrail securely adjoining the at least one newel post to the at least one baluster. As will be appreciated by the skilled person, in some embodiments it is contemplated that the newel post can be a vertical load bearing component that is also adapted to withstand lateral forces and the baluster can be primarily adapted to withstand lateral forces.

It is contemplated that the present balustrade system can be installed in both horizontal applications and angled or inclined applications as the case may be and as will be readily appreciated by the skilled person.

It is further contemplated that in some embodiments the individual components of the present balustrade system can be constructed of different materials to give a composite result. In other embodiments, it is contemplated that each component may be formed of the same material, which could be wood, aluminum, galvanized, stainless or carbon steel, wrought iron, or any other suitable material having the requisite physical properties as will be readily appreciated by the skilled person.

It is contemplated that the individual components of the present balustrade system can be manufactured using any suitable manufacturing technique that will be readily appreciated by the skilled person, including but not limited to, welding, milling, casting, extrusion and woodworking among any other suitable manufacturing techniques. Moreover, it is contemplated that each individual component may be formed of a single, unitary component or a number of smaller sub-components suitably joined together by any known technique, including but not limited to welding, mechanical fastening or interference fits.

It is also contemplated that each component of the present balustrade system and the overarching balustrade system itself can be constructed in any dimensions as required by the specific end user application of the present invention.

It is contemplated that any suitable handrail, without limitation, can be constructed of any suitable material by any known means can be employed in connection with the present invention. In some embodiments, the suitable handrail has an undersurface that is generally flat in order to permit fastening the present balusters or newel post to this undersurface by way of any suitable means.

In at least one embodiment, a baluster for use in connection with the present balustrade system has a baluster shaft that longitudinally extends between a first end and a second end.

It is contemplated that each end can further include a swivel mount for fixing either end of the baluster to a generally flat support surface in a pivotable way, as will be readily understood by the skilled person. As such, both the mounting handrail and/or the mounting surface can deviate significantly from horizontal and the present baluster can still be installed in a generally vertical fashion.

Each end of the baluster can include a transversely oriented bore that passes completely through the baluster and is oriented on a centreline of the baluster. It is contemplated that this transversely oriented bore is adapted to receive pivoting means, such as but not limited to a rivet, shaft, or pin, in order to connect the mounting swivel to either end of the baluster in a pivoting fashion, as will be discussed in further detail below. Moreover, it is contemplated that the end of the baluster shaft can be a separate component that is suitably joined to the baluster shaft or a single unitary component, depending on the needs of the specific end user application.

It is contemplated that each end of the baluster can include either a single projecting flange that includes the transverse bore or alternatively each end of the baluster can include two projecting flanges that house the transverse bore, among other suitable arrangements. As will be understood by the skilled person, the end of the baluster will be selected such that it can smoothly engage with the receiving flanges of the swivel mount, as will be discussed in further detail below.

In arrangements where the end of the baluster includes two projecting flanges it is contemplated that the swivel mount can include a centrally oriented, single receiving flange and in arrangements were the end of the baluster includes a single, centrally oriented projecting flange it is contemplated that the swivel mount can include a pair of receiving flange oriented along the longitudinal edges of the swivel mount, as will be discussed in further detail below.

It is also contemplated that the edges of the end of the baluster that are parallel to the transverse bore may be filleted to give the end of the baluster a generally rounded profile when viewed from a side elevation. It is contemplated that this filleting creates a baluster end that is adapted to smoothly interface with the swivel mount and which permits pivoting of the swivel mount relative to the baluster in an unimpeded fashion. Moreover, these fillets can also increase the access clearance to the mounting hardware that is used to fix the swivel mount to a generally flat support surface, as will be discussed in further detail below.

In at least one embodiment, the mounting swivel has a flat mounting plate, and at least one receiving flange. In some embodiments it is contemplated that there are two receiving flanges oriented in a perpendicular fashion along the longitudinal edges of the mounting plate and in other embodiments it is contemplated that there is only one receiving flange oriented along the longitudinal centreline of the mounting plate, among other arrangements that will be readily appreciated by the skilled person.

It is contemplated that the mounting plate can include at least one bore, which in some embodiments can be a countersunk bore for receiving suitable mounting hardware which could be a mechanical fastener such as a wood screw or a machine screw. In this way, the swivel mount can be fixed to a generally flat surface by way of at least one mechanical fastener inserted through the bore into the underlying surface.

Moreover, it is contemplated that the bore can be oriented along an axis that deviates from perfect verticality relative to the mounting swivel in order to facilitate placement of a mechanical fastener with a power tool during installation of the baluster, as will be readily appreciated by the skilled person.

As discussed previously, the receiving flange is oriented in a perpendicular fashion to the mounting plate and each receiving flange includes a co-aligned bore which is adapted to receive pivoting means, such as but not limited to a rivet, shaft, or pin. In some embodiments this receiving bore is threaded and in others it may not be threaded, depending on the needs of the end user application.

In this way, the pivoting means can pivotally link the end of the baluster (thought the transverse bore) to the swivel mount (through the co aligned bores) in order to permit rotation of one such component relative to the other, as will be understood by the skilled person.

It is further contemplated that a baluster for use in connection with the present balustrade system further includes a swivel cap that is adapted to cover the swivel mount in an aesthetically pleasing fashion and which also limits access to the baluster's mounting hardware. It is contemplated that the swivel cap has a continuous perimeter wall which can take any suitable shape (including but not limited to a square, circle, polygon, etc.) and further includes a cooperating plate cover having an opening.

It is contemplated that the plate cover may be integrally formed with the continuous perimeter wall or that it can be a separate component that is suitably joined to the continuous perimeter wall. In embodiments where the plate cover is removable it is contemplated that a lower surface of the plate cover can further include a recessed perimeter wall that is set back from the perimeter edge of the plate cover. In some embodiments this recessed perimeter wall extends around the plate cover in a recessed and continuous fashion and in other embodiments it is contemplated that this recessed perimeter wall extends around the plate cover in a recessed and discontinuous fashion, depending on the particular needs of the specific end user application.

In this way, the components can be sized such that an outer edge of the recessed perimeter wall frictionally engages an inner perimeter surface of the continuous perimeter wall such that the plate cover is firmly but removeably engaged with the continuous perimeter wall when the swivel cap is fully installed.

It is contemplated that the opening can have a number of shapes depending on the needs of the end user application. In some embodiments where the plate cover is removable, it is contemplated that different plate covers have different sized and shaped openings and the plate cover can be selected or changed out depending on the needs of the user and the cross-sectional shape of the baluster.

More specifically and as will be understood by the skilled person, in arrangements where the baluster is mounted to a generally flat surface, the swivel mount will be oriented generally perpendicular to the baluster and the opening that is needed in order to snugly receive the baluster shaft will be generally symmetrical and located roughly at the geometric centre of the plate cover.

However, in arrangements where the baluster is mounted to a generally angled surface, the swivel mount (and, by extension, the swivel cap) will be oriented at an angle relative to the baluster and the opening that is needed in order to snugly receive the baluster shaft will be asymmetrical and not located exactly at the geometric centre of the plate cover, as will be appreciated by the skilled person.

In short and as will be readily appreciated by the skilled person, the actual shape of the opening in the plate cover (including but not limited to circular, square, elliptical, rectangular, etc.) will depend on the cross-sectional shape of the baluster shaft at the position where the shaft is received in the opening of the plate cover.

It is contemplated that in some embodiments, the baluster can be a composite baluster having a composite baluster shaft that is constructed of multiple separate components formed of potentially different materials and suitably joined together.

In at least one embodiment, it is contemplated that the composite baluster shaft has a first intermediary shaft component that longitudinally extends between a first end and a second end. In this embodiment, the first end of the first intermediary shaft component can be considered coincident with the first end of the baluster and the second end of the first intermediary shaft component abuts a first plate.

In an analogous and symmetric manner, it is contemplated that in some embodiments the baluster shaft can have a second intermediary shaft component that longitudinally extends between a first end and a second end. In this embodiment, the first end of the second intermediary shaft component can be considered coincident with the second end of the baluster and the second end of the second intermediary shaft component abuts a second plate.

Both first intermediary shaft component and second intermediary shaft component can be sized according to the needs of the specific end user application, as some applications require a taller balustrade than other applications.

In these embodiments, the plates have a first surface that abut the intermediary shaft component and a second surface that abuts a post insert. It is contemplated that the post insert can be removable and constructed of any suitable material depending on the needs of the end user application, including but not limited to various species of wood and any suitable metal or composite material, as the case may be.

In some embodiments, each plate has a projecting perimeter rim that projects from second surface of the plate such that an inner surface of the projecting perimeter rim engages the outer surface of the post insert at a position adjacent either end of the post insert when the entire composite baluster is installed, as will be readily understood by the skilled person.

It is contemplated that each respective intermediary shaft component can be a unitary component with its respective plate or can be assembled of separate components that are suitably joined together. In embodiments where these components are separate and joined together, it is contemplated that the abutting end of the intermediary shaft component includes a projecting non-circular rim (such as, but not limited to, a key) that cooperates with a corresponding non-circular bore (such as, but not limited to, a keyway) on the first surface of the plate. In this way, the projecting non-circular rim engages with the corresponding non-circular bore in order to prevent rotation of these two parts relative to one another when the composite baluster shaft is being installed, as will be readily installed by the skilled person.

As will be readily appreciated, in order to prevent rotation, the only requirement for the shape of the rim and the bore is that these components are non-circular and do not rotate relative to one another when installed. As such, various shapes are contemplated including squares, ovals, triangles, eccentric shapes and obrounds, among any other suitable non-circular shape as will be readily appreciated by the skilled person.

In some embodiments it is contemplated that the baluster for use in connection with the present balustrade system is height-adjustable depending on the needs of the particular end-user application.

In these embodiments, it is contemplated that the baluster shaft can further include a first sleeve that fits within an opening provided within a second sleeve. In this way the first sleeve can be fixed relative to the second sleeve by way of securing means provided on the second sleeve.

More specifically, in some embodiments it is contemplated that the securing means can be a set screw and the second sleeve can further include a reinforcing collar oriented about a perimeter of the opening in the second sleeve. The collar can have a laterally oriented threaded bore that is adapted for receiving the set screw. In this way the set screw can be tightened such that the end of the set screw can frictionally abuts an outer surface of the first sleeve, thereby securing the first sleeve relative to the second sleeve.

In at least one embodiment, a newel post for use in connection with the present balustrade system has a shaft extending between a first end and a second end and a mounting plate abutting the first end of the shaft and adapted for fixing the newel post to a lower supporting surface.

It is contemplated that shaft can be sized according to the needs of the specific end user application, as some applications require a taller balustrade than other applications.

In some embodiments, a plate abutting the second end of the shaft is provided and an intermediary shaft portion having a second end abutting the plate and a first end having a swivel mount adapted for fixing the newel post to the underside of a handrail.

It is contemplated that the first end of the intermediary shaft portion can include either a single projecting flange that includes a transverse bore or alternatively each end of the baluster can include two projecting flanges that house a transverse bore, among other suitable arrangements. As will be understood by the skilled person, the first end of the intermediary shaft portion will be selected such that it can smoothly engage with the receiving flanges of the swivel mount, as will be discussed in further detail below.

In arrangements where the first end of the intermediary shaft portion includes two projecting flanges it is contemplated that the swivel mount can include a centrally oriented, single receiving flange and in arrangements were the first end of the intermediary shaft portion includes a single, centrally oriented projecting flange it is contemplated that the swivel mount can include a pair of receiving flange oriented along the longitudinal edges of the swivel mount, as is discussed in further detail herein.

As such, it is contemplated that the swivel mount for use in connection with the newel post can be considered analogous to the swivel mount that is contemplated for use in connection with the present baluster, as previously discussed.

In some embodiments it is contemplated that the mounting plate of the newel post is a separate component that has an upper surface that has a recessed upwardly projecting perimeter rim fits within a perimeter opening provided on the shaft of the newel post at a position coincident with the first end of the shaft. In these embodiments it is contemplated that the recessed downwardly projecting perimeter rim can engage an inner surface of the perimeter opening of the shaft when the newel post is installed.

It is also contemplated that in some embodiments the plate of the newel post has a lower surface having a recessed downwardly projecting perimeter rim. In these embodiments, the second end of the shaft of the newel post also has a perimeter opening and the recessed downwardly projecting perimeter rim can engage an inner surface of the perimeter opening of the shaft when the newel post is installed.

In some embodiments this recessed downwardly projecting perimeter rim extends around the lower surface of the plate in a recessed and continuous fashion and in other embodiments it is contemplated that this recessed downwardly projecting perimeter rim extends around the plate in a recessed and discontinuous fashion, depending on the particular needs of the specific end user application.

It is further contemplated that the first end of the intermediary shaft portion further can include a transverse bore adapted to receive a swivel mount as discussed previously. Moreover, in some embodiments it is contemplated that at least one edge parallelly aligned with the transverse bore of the first end of the intermediary shaft portion can be filleted to create an end having a generally rounded profile when viewed from a side elevation which permits pivoting of the swivel mount relative to the end of the newel post in an unimpeded fashion. Moreover, these fillets can also increase the access clearance to the mounting hardware that is used to fix the swivel mount to a generally flat support surface, as will be discussed in further detail below.

In some embodiments it is contemplated that the newel post can include a cap that is largely analogous to the swivel cap discussed previously. In some embodiments, this cap has a continuous perimeter wall and a plate cover which has a centrally oriented opening sized to accommodate the shaft of the newel post at a position adjacent to the first end of the shaft.

Figure 1B:
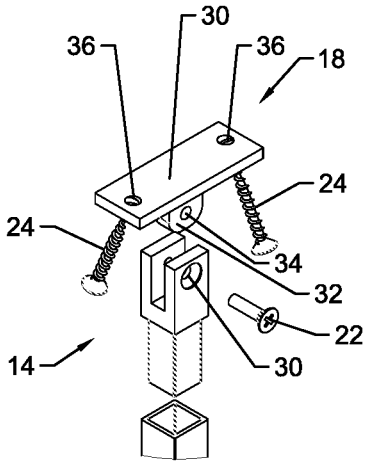
Figure 1C:
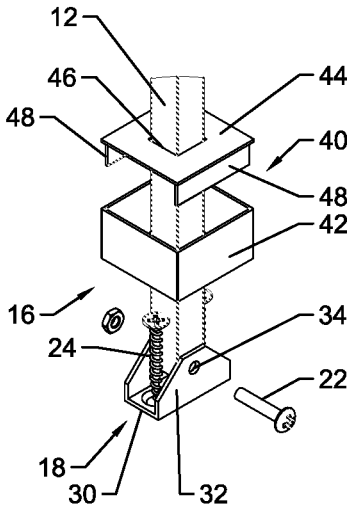

Turning to FIGS. 1A through 1C, at least one embodiment of a baluster in accordance with the present invention is illustrated. In this embodiment, baluster 10 has a baluster shaft 12 that longitudinally extends between a first end 14 and a second end 16.

In this embodiment, both first end 14 and second end 16 of baluster 10 each include a swivel mount 18 for fixing either end 14, 16 of the baluster to a generally flat support surface in a pivotable way. As such, the mounting handrail and/or the mounting surface can deviate significantly from horizontal and baluster 10 can still be installed in a generally vertical fashion regardless of the supporting surface orientation.

Each end 14, 16 of baluster 10 can include a transversely oriented bore 20 that passes completely through baluster 10 and can be oriented on a centreline of baluster 10. It is contemplated that transversely oriented bore 20 is adapted to receive pivoting means 22, such as but not limited to a rivet, shaft, or pin, in order to connect the mounting swivel to either end of baluster 10 in a pivoting fashion, as will be discussed in further detail below.

It is also contemplated that the edges of each end 14, 16 of baluster 10 that are parallel to transverse bore 20 may be filleted to give the end of the baluster a generally rounded profile (not shown). It is contemplated that this filleting creates a baluster end that is adapted to smoothly interface with swivel mount 18 and which permits pivoting of swivel mount 18 relative to baluster 10 in an unimpeded fashion. Moreover, these fillets can also increase the access clearance to the mounting hardware 24 that is used to fix swivel mount 18 to a generally flat support surface.

In this embodiment, mounting swivel 18 has a flat mounting plate 30, and at least one receiving flange 32. It is contemplated that mounting plate 30 includes at least one bore 36, which in some embodiments can be a countersunk bore for receiving suitable mounting hardware 24 which could be a mechanical fastener such as a wood screw or a machine screw. In this way, swivel mount 18 can be fixed to a generally flat surface by way of at least one mechanical fastener inserted through bore 36 into the underlying surface.

Moreover, it is contemplated that bore 36 can be oriented along an axis that deviates from perfect verticality relative to the mounting swivel in order to facilitate placement of a mechanical fastener with a power tool during installation of baluster 10, as will be readily appreciated by the skilled person.

Each receiving flange 32 is oriented in a perpendicular fashion relative to mounting plate 30 and each receiving flange includes a co-aligned receiving bore 34 which is adapted to receive pivoting means 22, such as but not limited to a rivet, shaft, or pin. In some embodiments this co-aligned receiving bore 34 is threaded and in others it may not be threaded, depending on the needs of the end user application.

In this way, pivoting means 22 can pivotally link each end 14, 16 of baluster 10 (though transverse bore 20) to the swivel mount 18 (through co aligned receiving bores 34) in order to permit rotation of one such component relative to the other, as will be understood by the skilled person.

It is further contemplated that in this embodiment, baluster 10 further includes a swivel cap 40 that is adapted to cover swivel mount 18 in an aesthetically pleasing fashion and which also limits access to mounting hardware 24 of baluster 10. It is contemplated that swivel cap 40 has a continuous perimeter wall 42 which can take any suitable shape (including but not limited to a square, circle, polygon, etc.) and further includes a cooperating plate cover 44 having an opening 46.

It is contemplated that plate cover 44 may be integrally formed with continuous perimeter wall 42 or that it can be a separate component that is suitably joined to continuous perimeter wall 42. In this embodiment, plate cover 44 is removable and it is contemplated that a lower surface of plate cover 44 can further include a recessed perimeter wall 48 that is set back from the perimeter edge of the plate cover 44. In this way, the components can be sized such that an outer edge of the recessed perimeter wall 48 frictionally engages an inner perimeter surface of continuous perimeter wall 42 such that plate cover 44 is firmly but removeably engaged with continuous perimeter wall 42 when swivel cap 40 is fully installed.

It is contemplated that opening 46 can have a number of shapes depending on the needs of the end user application. In some embodiments where plate cover 44 is removable, it is contemplated that different plate covers have different sized and shaped openings and plate cover 44 can be selected or changed out depending on the needs of the user.

More specifically and as will be understood by the skilled person, in arrangements where baluster 10 is mounted to a generally flat surface as in this embodiment, swivel mount 18 will be oriented generally perpendicular to baluster 10 and opening 46 that is needed in order to snugly receive baluster shaft 12 will be generally symmetrical and located roughly at the geometric centre of the plate cover 44.

In this embodiment, it is contemplated that baluster 10 is height-adjustable depending on the needs of the particular end-user application.

In these embodiments, it is contemplated that baluster shaft 12 can further include a first sleeve 50 that fits within an opening provided within a second sleeve 52. In this way first sleeve 50 can be fixed relative to second sleeve 52 by way of securing means provided on the second sleeve 52.

More specifically, in this embodiment it is contemplated that securing means is a set screw 54 and second sleeve 52 further includes a reinforcing collar 56 oriented about a perimeter of the opening in second sleeve 52. Reinforcing collar 56 can have a laterally oriented threaded bore 53 that is adapted for receiving set screw 54. In this way set screw 54 can be tightened such that the end of set screw 54 can frictionally abut an outer surface of first sleeve 52, thereby securing first sleeve 52 relative to second sleeve 54.

Figure 2A:
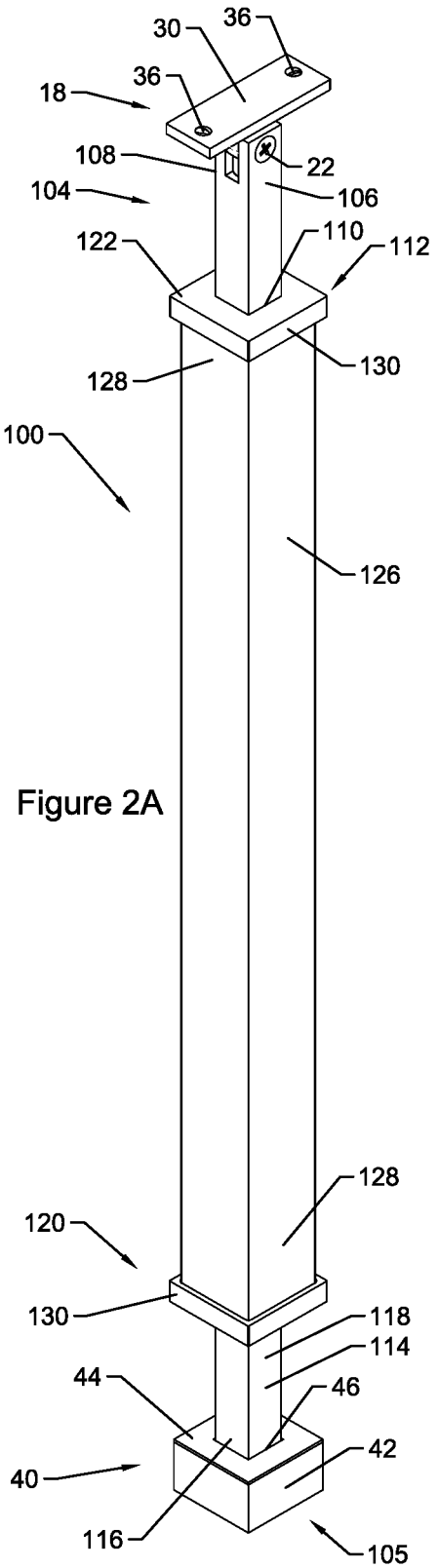
FIGS. 2A through 2C are isometric views of another baluster for use in connection with balustrade system in accordance with at least one embodiment of the present invention.
Figure 2B:
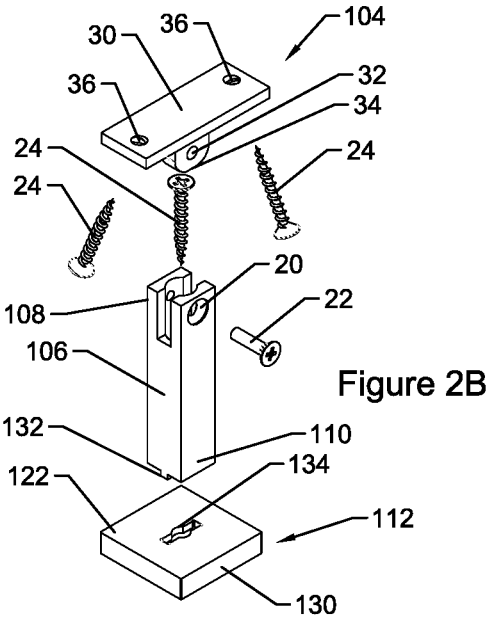
Figure 2C:
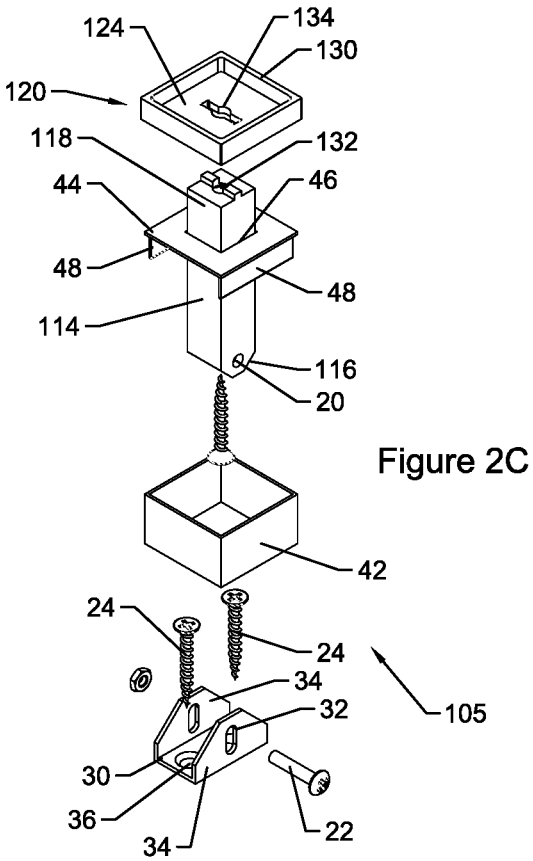

Turning to FIGS. 2A through 2C, another embodiment of a baluster for use in connection with the present balustrade system is illustrated. In this embodiment, baluster is a composite baluster 100 having a composite baluster shaft 102 that is constructed of multiple separate components formed of potentially different materials and suitably joined together.

In this embodiment, first end 104 of baluster shaft 102 has a first intermediary shaft component 106 that longitudinally extends between a first end 108 and a second end 110. In this embodiment, first end 108 of first intermediary shaft component 106 can be considered coincident with first end 104 of baluster 100 and second end 110 of first intermediary shaft component 106 abuts a first plate 112.

In an analogous and symmetric manner, it is contemplated that in this embodiment the second end 105 of baluster shaft 102 can have a second intermediary shaft component 114 that longitudinally extends between a first end 116 and a second end 118. In this embodiment, first end 116 of second intermediary shaft component 114 can be considered coincident with second end 105 of baluster 100 and second end 118 of second intermediary shaft component 114 abuts a second plate 120.

In this embodiment, swivel mount 18 and baluster ends 104, 105 and swivel cap 40 can be considered analogous to the swivel mount, baluster ends and swivel cap discussed previously in connection to FIGS. 1A through 1C.

In this embodiment, plates 112, 120 have a first surface 122 that abut the second ends 110, 118 of intermediary shaft component 106, 114 and a second surface 124 that abuts a respective end 128 of a post insert 126. It is contemplated that post insert 126 can be removable and constructed of any suitable material depending on the needs of the end user application, including but not limited to various species of wood and any suitable metal or composite material, as the case may be.

In some embodiments, each plate 112, 120 has a projecting perimeter rim 130 that projects from second surface 124 and which engages an outer surface of post insert 126 adjacent each end 128 of post insert 126 when the entire composite baluster 100 is installed, as will be readily understood by the skilled person.

In this embodiment, it is contemplated that the length of each respective intermediary shaft component 106, 114 can be varied depending on the needs of the particular end user application, thereby lending a degree of height adjustability to composite baluster 100.

It is contemplated that each respective intermediary shaft component 106, 114 can be a unitary component with its respective plate 112, 120 or can be assembled of separate components that are suitably joined together. In this embodiment, these components are separate and joined together and it is contemplated that the abutting second end 110, 118 of intermediary shaft component 106, 114 includes a projecting non-circular rim 132 that cooperates with a corresponding non-circular bore 134 extending through plate 112, 120. In this way, projecting non-circular rim 132 engages with non-circular bore 134 in order to prevent rotation of these two parts relative to one another when composite baluster 100 is being installed, as will be readily installed by the skilled person.

Figure 3A:
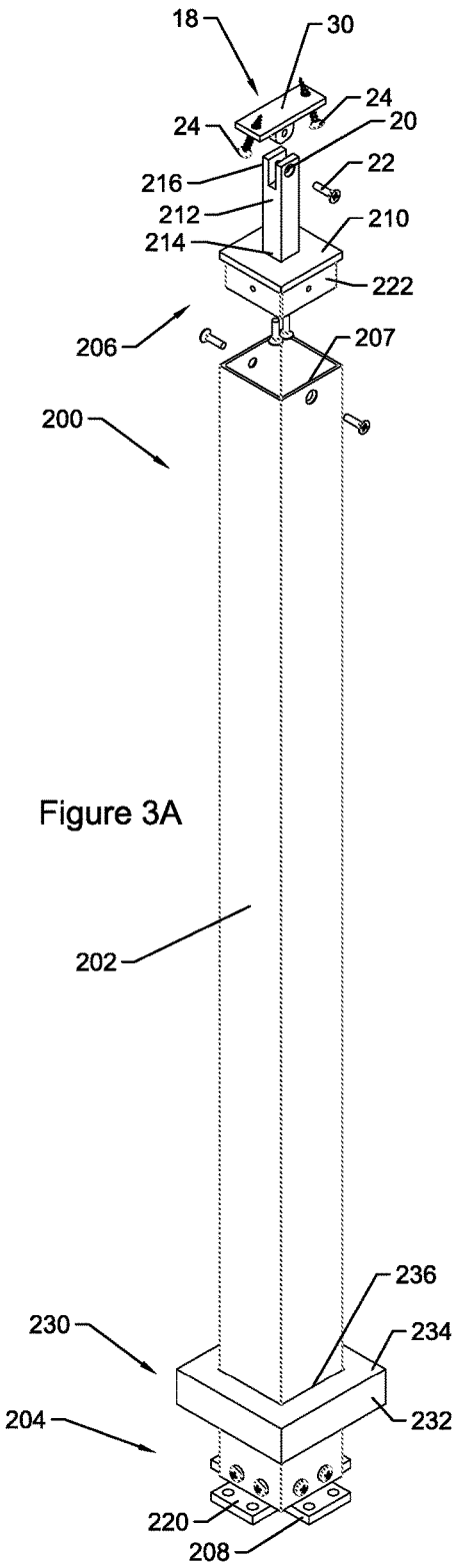
FIGS. 3A through 3C are isometric views of a newel post for use in connection with balustrade system in accordance with at least one embodiment of the present invention.
Figure 3B:
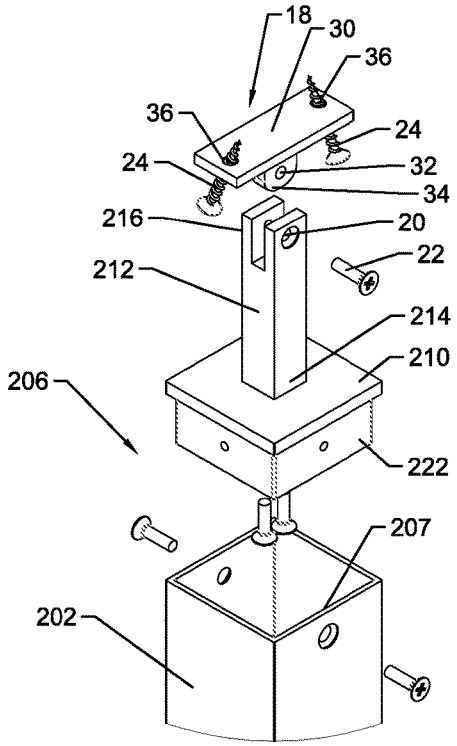
Figure 3C:
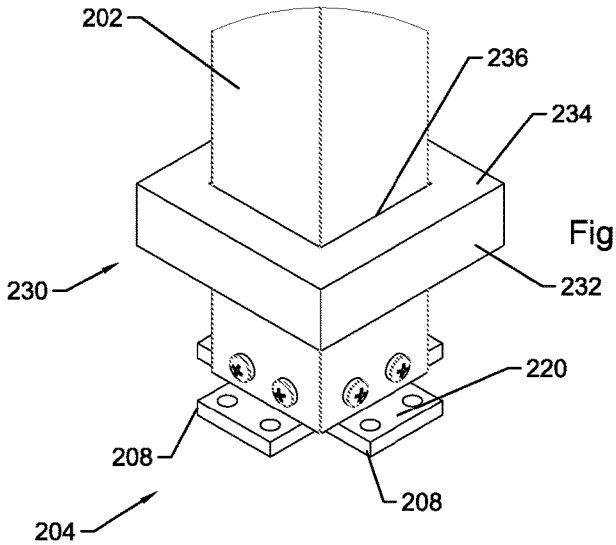

Turning to FIGS. 3A through 3C, at least one embodiment of a newel post in accordance with the present invention is illustrated. In this embodiment, newel post 200 has a shaft 202 extending between a first end 204 and a second end 206 and a mounting plate 208 abutting first end 204 of shaft 202 and adapted for fixing newel post 200 to a lower supporting surface.

In this embodiment, a plate 210 abutting second end 206 of shaft 202 is provided having an intermediary shaft portion 212 having a first end 214 abutting plate 210 and a second end 216 having a swivel mount 218 adapted for fixing newel post 200 to the underside of a handrail.

In this embodiment, it is contemplated that the length of shaft 202 and intermediary shaft portion 212 can be varied depending on the needs of the particular end user application, thereby lending a degree of height adjustability to newel post 200.

In this embodiment, it is contemplated that swivel mount 218 for use in connection with newel post 200 can be considered analogous to swivel mount 18 that is contemplated for use in connection with baluster 10, as previously discussed.

In this embodiment, it is contemplated that mounting plate 208 of newel post 200 is a separate component that has an upper surface 220 having a recessed upwardly projecting perimeter rim (not shown) fitting within a perimeter opening provided on shaft 202 of newel post 200 at a position coincident with first end 204 of the shaft 202. In this embodiment it is contemplated that the recessed upwardly projecting perimeter rim 222 can engage an inner surface of the perimeter opening of the shaft 202 when newel post 200 is installed.

It is also contemplated that this embodiment plate 210 of the newel post 200 has a lower surface (not shown) having a recessed downwardly projecting perimeter rim 222. In this embodiment, second end 206 of shaft 202 of newel post 200 also has a perimeter opening 207 and recessed downwardly projecting perimeter rim 222 can engage an inner surface of the perimeter opening 207 of shaft 202 when newel post 200 is installed.

It is further contemplated that in this embodiment, first end 216 of intermediary shaft portion 212 further includes a transverse bore 224 adapted to receive swivel mount 218 as discussed previously. Moreover, in some embodiments it is contemplated that at least one edge parallelly aligned with the transverse bore can be filleted to create an end having a generally rounded profile which permits pivoting of swivel mount 218 relative to newel post 200 in an unimpeded fashion. Moreover, these fillets can also increase the access clearance to mounting hardware 24 that is used to fix swivel mount 218 to a generally flat support surface, as will be discussed in further detail below.

In this embodiment, it is contemplated that newel post 200 can include a cap 230 that is largely analogous to swivel cap 40 discussed previously. In this embodiment, cap 230 has a continuous perimeter wall 232 and a plate cover 234 which has a centrally oriented opening 236 sized to accommodate the shaft of the newel post at a position adjacent to the first end of the shaft.

Figures 4A, 4B, 4C:
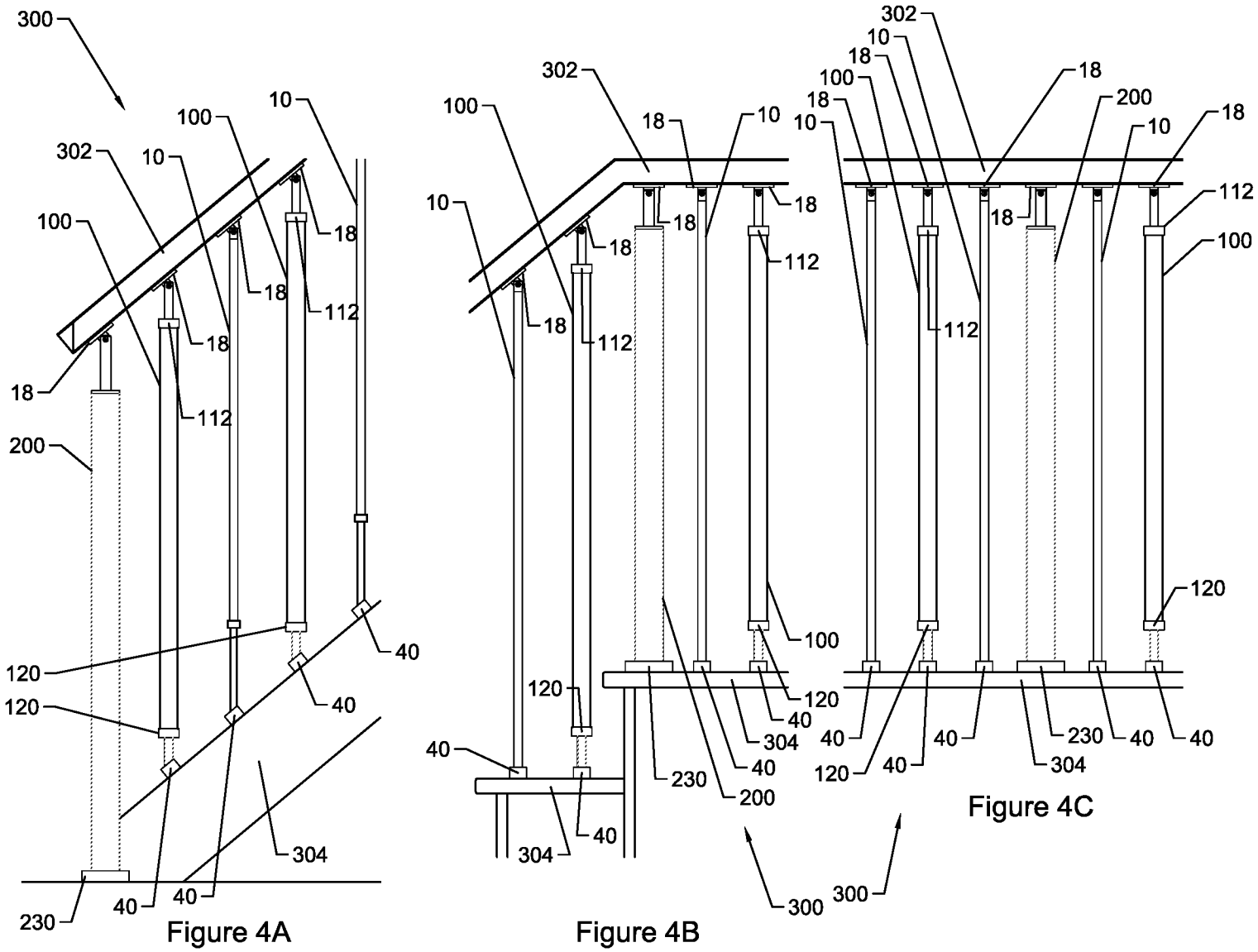
FIGS. 4A through 4C are elevation views of a balustrade system in accordance with at least one embodiment of the present invention.

Turning to FIGS. 4A through 4C, at least one embodiment of a balustrade system in accordance with the present invention is illustrated. In this embodiment balustrade 300 includes a railing 302 that secures together balusters 10, composite balusters 100 and newel posts 200 into a balustrade 300 mounted to a lower supporting surface 304, as previously discussed. Other components, discussed previously can be seen including swivel mount 18, swivel cap 40, cap 230, first plate 112 and second plate 120.

In these embodiments, it can be seen that railing 302 and lower support surface 304 can be oriented horizontally or non-horizontally depending on the needs of the particular end user application. Moreover, swivel cap 40 and cap 230 cover the respective mounting arrangement of the lower ends of the baluster, composite baluster and newel post (as the case may be) to improve the aesthetics of the resulting assembly and also to limit access to the mounting hardware (not shown) once the balustrade is installed.

As will be appreciated by the skilled person, balustrade 10 is height adjustable depending on the needs of the particular end user application. Moreover, post insert 126 of composite baluster 100 can be switched depending on the desired aesthetics of the particular end user application.

In this way, the present invention can provide a modular balustrade system that is visually appealing, adaptable and adjustable for a wide range of applications, easy to install and robust.

The skilled person will readily appreciate that the present embodiments discussed herein are introduced for exemplary purposes only and the protection sought will be limited only by the scope of the attached claims.

We claim:

1. A baluster for a baluster system, the baluster comprising:

a first end having a swivel mount adapted for fixing to the underside of a handrail;

a second end having a swivel mount for fixing to a lower supporting surface; and a baluster shaft extending between said first end and said second end; and a swivel cap adapted to house said swivel mount of said second end of said baluster, said swivel cap comprising:

a continuous perimeter wall having an inner rim, and a plate cover having an opening sized to accommodate said baluster and a recessed perimeter wall, wherein said recessed perimeter wall frictionally engages said inner rim.

2. The baluster of claim 1 wherein said opening of said plate cover is square-shaped and centrally positioned on said plate cover.

3. The baluster of claim 1 wherein said opening of said plate cover is rectangular-shaped and eccentrically positioned on said plate cover.

4. The baluster of claim 1 wherein said baluster shaft further comprises:

a first intermediary shaft component extending between a first end and a second end, said first end of said first intermediary shaft component coinciding with said first end of said baluster, said second end of said first intermediary shaft component abutting a first plate, said first plate having a raised perimeter rim;

a second intermediary shaft component extending between a first end and a second end, said first end of said second intermediary shaft component coinciding with said second end of said baluster, said second end of said second intermediary shaft component abutting a second plate, said second plate having a raised perimeter rim; and a post insert extending between a first end and a second end, said first plate abutting said first end of said post insert such that said perimeter rim of said first plate engages said first end of said post insert to prevent rotation of said post insert relative to said first plate, said second plate abutting said second end of said post insert such that said perimeter rim of said second plate engages said second end of said post insert to prevent rotation of said post insert relative to said second plate.

5. The baluster of claim 4 wherein at least one of said second end of said first shaft component and said second end of said second shaft component further comprises a non-circular projecting rim, and wherein a corresponding at least one of said first plate and said second plate further comprises a non-circular bore, wherein said non-circular projecting rim fits snugly within said non-circular bore in a manner preventing rotation of said non-circular projecting rim relative to said non-circular bore.

6. The baluster of claim 1 wherein said baluster shaft further comprises a first sleeve that fits within an opening provided within a second sleeve, wherein said first sleeve can be fixed relative to said second sleeve by way of securing means.

7. The baluster of claim 6 wherein said securing means are a set screw and said second sleeve further comprises a collar about a perimeter of said opening, said collar having a laterally oriented threaded bore for receiving said set screw, said set screw having an end which abuts an outer surface of said first sleeve when threaded in a secure position.

8. The baluster of claim 1, wherein at least one of said swivel mounts has at least one countersunk screw bore, said at least one countersunk screw bore aligned along a non-vertical axis to facilitate placement of a mounting screw in a non-vertical orientation relative to said swivel.

9. The baluster of claim 1, wherein at least one of said first end of said baluster and said second end of said baluster further comprises a transverse bore adapted to receive said swivel mount and wherein at least one edge parallelly aligned with said transverse bore is filleted to encourage pivoting clearance with said swivel mount.

10. A newel post for a baluster system, the newel post comprising:

a shaft extending between a first end and a second end;

a mounting plate abutting said first end of said shaft and adapted for fixing said newel post to a lower supporting surface;

a plate abutting said second end of said shaft;

an intermediary shaft portion having a first end abutting said plate and a second end having a swivel mount adapted for fixing to the underside of a handrail; and a swivel cap adapted to house said swivel mount, said swivel cap comprising:

a continuous perimeter wall having an inner rim, and a plate cover having an opening sized to accommodate said shaft, and a recessed perimeter wall, wherein said recessed perimeter wall frictionally engages said inner rim.

11. The newel post of claim 10 wherein said mounting plate further comprises an upper surface having a recessed upwardly projecting perimeter rim and wherein said first end of said shaft comprises a perimeter opening, said recessed upwardly projecting perimeter rim engaging an inner surface of said perimeter opening.

12. The newel post of claim 10 wherein said plate further comprises a lower surface having a recessed downwardly projecting perimeter rim and wherein said second end of said shaft comprises a perimeter opening, said recessed downwardly projecting perimeter rim engaging an inner surface of said perimeter opening.

13. The newel post of claim 10, wherein said swivel mount has at least one countersunk screw bore, said at least one countersunk screw bore aligned along a non-vertical axis to facilitate placement of a mounting screw in a non-vertical orientation relative to said swivel.

14. The newel post of claim 10, wherein said first end of said intermediary shaft portion further comprises a transverse bore adapted to receive said swivel mount and wherein at least one edge parallelly aligned with said transverse bore is filleted to encourage pivoting clearance with said swivel mount.

15. A balustrade system comprising:

a handrail extending between a first end and a second end and a having lower surface, at least one newel post having a shaft extending between a first end and a second end, a mounting plate abutting said first end of said shaft and adapted for fixing said newel post to a lower supporting surface, a plate abutting said second end of said shaft;

an intermediary shaft portion having a first end abutting said plate and a second end having a swivel mount adapted for fixing to the underside of the handrail;

at least one baluster vertically extending between a first end and a second end, the baluster having a first end having a swivel mount adapted for fixing to the underside of the handrail, a second end having a swivel mount for fixing to a lower supporting surface, and a baluster shaft extending between said first end and said second end; and a swivel cap adapted to house said swivel mount of said second end of said baluster, said swivel cap comprising:

a continuous perimeter wall having an inner rim, and a plate cover having an opening sized to accommodate said baluster, and a recessed perimeter wall, wherein said recessed perimeter wall frictionally engages said inner rim.

16. The balustrade system of claim 15 wherein said opening of said plate cover is square-shaped and centrally positioned on said plate cover.

17. The balustrade system of claim 15 wherein said opening of said plate cover is rectangular-shaped and eccentrically positioned on said plate cover.

18. The balustrade system of claim 15 wherein said baluster shaft further comprises:

a first intermediary shaft component extending between a first end and a second end, said first end of said first intermediary shaft component coinciding with said first end of said baluster, said second end of said first shaft component abutting a first plate, said first plate having a raised perimeter rim;

a second intermediary shaft component extending between a first end and a second end, said first end of said second intermediary shaft component coinciding with said second end of said baluster, said second end of said second intermediary shaft component abutting a second plate, said second plate having a raised perimeter rim; and a post insert extending between a first end and a second end, said first plate abutting said first end of said post insert such that said perimeter rim of said first plate engages said first end of said post insert to prevent rotation of said post insert relative to said first plate, said second plate abutting said second end of said post insert such that said perimeter rim of said second plate engages said second end of said post insert to prevent rotation of said post insert relative to said second plate.

19. The balustrade system of claim 18 wherein at least one of said second end of said first intermediary shaft component and said second end of said second intermediary shaft component further comprises a projecting non-circular recessed rim, and wherein a corresponding at least one of said first plate and said second plate further comprises a non-circular bore, wherein said projecting non-circular recessed rim fits snugly within said non-circular bore in a manner preventing rotation of said projecting non-circular recessed rim relative to said non-circular bore.

20. The balustrade system of claim 15 wherein said baluster shaft further comprises a first sleeve that fits within an opening provided within a second sleeve, wherein said first sleeve can be fixed relative to said second sleeve by way of securing means.

21. The balustrade system of claim 20 wherein said securing means are a set screw and said second sleeve further comprises a collar about a perimeter of said opening, said collar having a laterally oriented threaded bore for receiving said set screw, said set screw having an end which abuts an outer surface of said first sleeve when threaded in a secure position.

22. The balustrade system of claim 15, wherein at least one of said swivel mounts has at least one countersunk screw bore, said at least one countersunk screw bore aligned along a non-vertical axis to facilitate placement of a mounting screw in a non-vertical orientation relative to said swivel.

23. The balustrade system of claim 15, wherein at least one of said first end of said baluster and said second end of said baluster further comprises a transverse bore adapted to receive said swivel mount and wherein at least one edge parallelly aligned with said transverse bore is filleted to encourage pivoting clearance with said swivel mount.

24. The balustrade system of claim 15 wherein said mounting plate of said newel post further comprises an upper surface having a recessed upwardly projecting perimeter rim and wherein said second end of said shaft comprises a perimeter opening, said recessed upwardly projecting perimeter rim engaging an inner surface of said perimeter opening.

25. The balustrade system of claim 15 wherein said plate of said newel post further comprises a lower surface having a recessed downwardly projecting perimeter rim and wherein said second end of said shaft comprises a perimeter opening, said recessed downwardly projecting perimeter rim engaging an inner surface of said perimeter opening.

26. The balustrade system of claim 15, wherein said swivel mount of said newel post has at least one countersunk screw bore, said at least one countersunk screw bore aligned along a non-vertical axis to facilitate placement of a mounting screw in a non-vertical orientation relative to said swivel.

27. The balustrade system of claim 15 wherein said first end of said intermediary shaft portion of said newel post further comprises a transverse bore adapted to receive said swivel mount and wherein at least one edge parallelly aligned with said transverse bore is filleted to encourage pivoting clearance with said swivel mount.

28. The balustrade system of claim 15 wherein said newel post further comprises a cap having a continuous perimeter wall and a plate cover, said plate cover having a centrally oriented opening sized to accommodate said shaft at a position adjacent said first end of said shaft.

* * * * *